US007520079B2

(12) United States Patent
Stallings et al.

(10) Patent No.: US 7,520,079 B2
(45) Date of Patent: Apr. 21, 2009

(54) NEONATAL IDENTIFICATION BAND

(75) Inventors: Jamie D. Stallings, Huntersville, NC (US); Gary Krause, Lake Wylie, SC (US)

(73) Assignee: Kabushiki Kaisha Sato, Tokyo (JP)

( * ) Notice: Subject to any disclaimer, the term of this patent is extended or adjusted under 35 U.S.C. 154(b) by 0 days.

(21) Appl. No.: 11/635,237

(22) Filed: Dec. 7, 2006

(65) Prior Publication Data

US 2007/0124973 A1 Jun. 7, 2007

Related U.S. Application Data

(60) Provisional application No. 60/748,251, filed on Dec. 7, 2005.

(51) Int. Cl.
*A44C 5/00* (2006.01)

(52) U.S. Cl. ..... 40/633; 40/630; 40/638; 428/195.1

(58) Field of Classification Search ..... 40/633, 40/638; 428/40.1, 41.7, 41.8, 41.9, 42.1, 428/42.2, 42.3, 43
See application file for complete search history.

(56) References Cited

U.S. PATENT DOCUMENTS

| | | | | |
|---|---|---|---|---|
| 3,335,937 | A | 8/1967 | Kramer | 229/38 |
| 4,577,426 | A * | 3/1986 | Jenkins | 40/638 |
| 4,916,841 | A * | 4/1990 | Dawson | 40/665 |
| 5,279,057 | A * | 1/1994 | Melin et al. | 40/630 |
| 5,653,472 | A * | 8/1997 | Huddleston et al. | 283/75 |
| 5,756,188 | A | 5/1998 | Reiter et al. | 428/195 |
| 5,799,426 | A | 9/1998 | Peterson | 40/633 |
| 5,842,722 | A | 12/1998 | Carlson | 283/107 |
| 6,055,756 | A | 5/2000 | Aoki | 40/633 |
| 6,066,378 | A | 5/2000 | Morii et al. | 428/40.2 |
| 6,426,139 | B1 * | 7/2002 | Ezra | 428/343 |
| 6,563,472 | B2 * | 5/2003 | Durham et al. | 343/781 P |
| 6,920,881 | B2 | 7/2005 | Narula et al. | 128/889 |
| 6,971,200 | B2 * | 12/2005 | Valenti, Jr. | 40/633 |
| 7,137,216 | B2 * | 11/2006 | Ali et al. | 40/633 |

* cited by examiner

*Primary Examiner*—Joanne Silbermann
*Assistant Examiner*—Shin Kim
(74) *Attorney, Agent, or Firm*—K&L Gates LLP

(57) ABSTRACT

A pliable pressure sensitive laminate structure, shaped removable identification band, method of identifying patients and assembly jig for use in securing shaped identification band around wrist or ankle of an infant or neonate. Pliable laminate structure has backing layer and substantially coextensive printable layer. Printable layer has printable side for printing thereon and an adhesive side. A cut through printable layer defines a removable portion having two equal-sized patient identification portions joined by connector band of lesser width. Adhesive layer between printable layer and backing layer removably adheres printable layer to backing layer such that when the removable portion is removed from the backing layer adhesive remains adhered to adhesive side of at least one patient identification portion and no adhesive remains adhered to the connector band. Related method of identifying patients by securing shaped pliable identification band around wrist or ankle and assembly jig are also disclosed.

31 Claims, 12 Drawing Sheets

NEONATAL IDENTIFICATION BAND

CROSS-REFERENCE TO RELATED APPLICATIONS

This application is entitled to the benefit of and claims priority to U.S. provisional application No. 60/748,251, filed on Dec. 7, 2005, the entirety of which is incorporated herein by reference.

FIELD

1. Technical Field

The invention relates generally to the field of pressure sensitive laminate structures and particularly to adhesive patient identification bands for attachment to the wrist or ankle of neonates and infants.

2. Background Information

To help prevent medical errors due to patient misidentification, many hospitals and other heath care providers use patient identification bands, which are secured around a patient's wrist or ankle. Printed on or attached to such identification bands is information such as a patient's name, date of birth, identification number, and sometimes even the patient's picture and an assigned barcode. Some patient identification bands use a mechanical closure device to secure the band around a patient's wrist or ankle. Other types of patient identification bands use an adhesive to adhere one end of the band to the other end of the band after the band is placed around a patient's wrist or ankle.

One concern associated with adhesive patient identification bands is that the adhesive used should be of the type that is approved for contact with human skin. Even when using adhesives approved for use with humans, one problem associated with known adhesive identification bands is that contact between the adhesive and a patient's skin still may cause discomfort and irritation to some patients.

Patient information is typically placed on identification bands in many ways. The identification band can be written on, stamped or thermally printed. When a band is thermally printed, patient information is printed on an adhesive label and the label is then adhered to the identification band or patient information is printed directly on the identification band before the band is secured around a patient's wrist or ankle. This results in the patient information being printed circumferentially around the patient's wrist or ankle when the band is worn by a patient. When using a thermal printer, it is important that the thickness, width and length of the identification band are compatible with the printer used to imprint patient identification information on the band. If the band is too thick, too thin or has a significantly non-uniform thickness, then the print head may not be able to accurately print patient information onto the identification band in the proper location as the band travels through the printer. If the width of the identification band is too narrow or too wide, then the band may not be able to properly travel through the printer.

While use of known patient identification bands has generally been found satisfactory for adult patients, there are disadvantages associated with use of these bands on infants and neonates, and especially on premature neonates. Neonates and infants have very small wrists and ankles and particularly delicate skin. These characteristics make it difficult to use conventional patient identification bands on neonates and infants, for at least two reasons. First, the identification bands must be small enough to fit securely around the wrist or ankle of an infant or neonate. Given the small size requirement, there may not be enough space on the band to print all the patient information desired. Second, even if there is sufficient space on the identification band to print all desired patient information, such information is often difficult or impossible to read while the neonate is lying down because a portion of the information that is circumferentially printed on the identification band is under the neonate's arm or leg.

The sensitive and delicate skin of neonates and infants also creates difficulties for attaching devices for known patient identification bands. Given such delicacy, adhesive identification bands are often preferred over bands having mechanical closure means because known mechanical closure means may rub, pinch or irritate an infant's or neonate's skin. But even when using adhesives approved for use with humans, contact of such adhesive with a neonate'sensitive skin can still result in skin irritation and associated discomfort. Additionally, it is thought to be desirable to minimize the width of a patient identification band when used on neonates in order to reduce the likelihood of the band binding or digging into the neonate's skin. But reducing such width not only reduces the printable area of the band, but also results in a band that cannot be fed through many existing printers.

As shown above, there is a need in the art for a patient identification band suitable for use with neonates and infants in birthing wards, delivery rooms, maternity wards, neonatal intensive care units and obstetric wards that overcomes the disadvantageous associated with known identification wristbands. Ideally, such an identification band would be compatible with conventional thermal printers; would use adhesive closure means, without allowing adhesive to contact the neonate; and would provide a printable area that is not only sufficient to print desired information but is also easily readable while the neonate is lying down.

SUMMARY

The present invention overcomes disadvantages of known identification bands by providing a pliable pressure sensitive laminate structure, a novel-shaped removable identification band for attachment around the wrist or ankle of an infant or neonate, a related method of identifying patients and an assembly jig for use in securing the identification band around the wrist or ankle of the infant or neonate.

The pliable pressure sensitive laminate structure has a backing layer and a printable layer substantially coextensive with the backing layer. The printable layer has a printable side suitable for printing thereon and an adhesive side. A cut through the printable layer defines a novel-shaped removable portion having two equal-sized patient identification portions joined by a connector band portion. The connector band portion has a width less than the width of each of the equal-sized patient identification portions. An adhesive layer between the printable layer and the backing layer removably adheres the printable layer to the backing layer such that when the removable portion of the printable layer is removed from the backing layer, adhesive remains adhered to the adhesive side of at least one of the equal-sized patient identification portions. No adhesive adheres to the connector band portion of the removable portion of the printable layer when it is removed from the backing layer.

Patient information is printed on the printable side of one or both of the equal-sized patient identification portions and the removable portion of the printable layer is then removed from the backing layer and secured around the wrist or ankle of an infant or neonate by wrapping the connector band portion around such wrist or ankle and pressing together the adhesive sides of the equal-sized patient identification portions, thereby causing the adhesive adhered on the adhesive side of at least one of the equal-sized patient identification portions to adhere the two equal-sized patient identification portions together.

The printable layer of the pliable laminate structure may advantageously be made from material suitable for direct thermal printing thereon. At least one uncut portion may be used to connect the removable portion of the printable layer to the other portion of the printable layer.

The adhesive layer in a preferred embodiment comprises a plurality of discrete adhesive deposits, one such adhesive deposit being adhered to the adhesive side of at least one of the equal-sized patient identification portions. Advantageously, to prevent adhesive from contacting a patient's skin when the identification band is secured around the patient's wrist or ankle, the adhesive deposit adhered to the adhesive side of an equal-sized patient identification portion is not coextensive with such equal-sized patient identification portion and does not abut the periphery of such equal-sized patient identification portion. The adhesive may be a hot melt pressure sensitive adhesive approved for human skin contact by the United States Food and Drug Administration.

In a preferred embodiment, six discrete adhesive deposits are positioned such that one adhesive deposit is an adhered to the adhesive side of each equal-sized patient identification portions, one adhesive deposit abuts each side of the laminate structure, and one adhesive deposit abuts each end of the laminate structure. The area of the adhesive layer may advantageously be at least fifty percent of the area of the adhesive side of said printable layer. The area of the adhesive layer may advantageously be less than eighty-one percent of the area of the adhesive side of the printable layer.

In addition to the laminate structure, the present invention also provides an identification band for attachment around an infant or neonate wrist or ankle of predetermined diameter. A pliable band having a printable side suitable for printing thereon and an adhesive side has a shape comprising two equal-sized patient identification portions joined by a connector band portion having a width less than the width of each of the equal-sized patient identification portions and a length greater than the predetermined diameter. Adhesive is adhered to the adhesive side of at least one of the two equal-sized patient identification portions but not adhered to the connector band portion. The adhesive may advantageously be adhered to the adhesive side of an equal-sized patient identification portion such that the adhesive does not abut the periphery of such equal-sized patient identification portion.

Patient information is printed on the printable side of one or both of the equal-sized patient identification portions. The identification band is secured around an infant or neonate wrist or ankle of predetermined diameter by wrapping the connector band portion around such wrist or ankle and pressing together the adhesive sides of the equal-sized patient identification portions, thereby causing the adhesive adhered on the adhesive side of at least one of the equal-sized patient identification portions to adhere the two equal-sized patient identification portions together.

The identification band for attachment around an infant or neonate wrist or ankle of predetermined diameter may be made of material suitable for direct thermal printing thereon. The adhesive may advantageously be a hot melt pressure sensitive adhesive approved for human contact by the United States Food and Drug Administration.

Also included within the present invention is a method of identifying an infant or neonate patient. Patient identification information corresponding to such infant or neonate patient is printed on a pliable laminate structure having a backing layer and a printable layer substantially coextensive with the backing layer. The printable layer has a printable side suitable for printing thereon and an adhesive side. A cut through the printable layer defines a removable portion having a shape comprising two equal-sized patient identification portions joined by a connector band portion having a width less than the width of each of the equal-sized patient identification portions. An adhesive layer between the printable layer and the backing layer removably adheres the printable layer to the backing layer. When the removable portion of the printable layer is removed from the backing layer, adhesive remains adhered to the adhesive side of at least one of the equal-sized patient identification portions and no adhesive remains adhered to the connector band portion of the removable portion.

The removable portion of the printable layer is removed from the backing layer and secured around the wrist or ankle of an infant or neonate patient by wrapping the connector band portion around such wrist or ankle and pressing together the adhesive sides of the equal-sized patient identification portions, thereby causing the adhesive adhered on the adhesive side of at least one of the equal-sized patient identification portions to adhere the two equal-sized patient identification portions together.

In a preferred embodiment, a kit for securing an identification band around the wrist or ankle of an infant or neonate is provided that comprises the aforementioned laminate structure and an assembly jig having an indentation zone with a length and width generally corresponding to the length and width of the patient identification portions of the pliable band. Lateral movement of a patient identification portion of the pliable band in the indentation zone is restricted by the assembly jig. An identification band may be secured around the wrist or ankle of the infant or neonate by placing one patient identification portion in the indentation zone of the assembly jig, wrapping the identification band around such wrist or ankle, aligning the other patient identification portion to be substantially coextensive with the patient identification portion in the indentation zone, and pressing together the two patient identification portions together to thereby cause the adhesive adhered on the adhesive side of at least one of the patient identification portions to adhere the two equal-sized patient identification portions together.

The present invention thus overcomes disadvantages of known identification bands when used on infants and neonates by providing an identification band with patient identification portions large enough to print all desired patient identification information; a narrower connector band portion around a patient's wrist or ankle that minimizes binding and discomfort; and adhesive closure means that in a preferred embodiment ensure that adhesive does not come into contact with the neonate's or infant's skin because the adhesive adhered to the patient identification portions does not abut the periphery of such portions. Because patient identification information is printed on the patient identification portions which, when joined together extend outwardly from the wrist or ankle, and not printed circumferentially around the identification band, such information is easily readable by medical personnel even when the neonate or infant is lying down.

BRIEF DESCRIPTION OF THE DRAWINGS

For a more complete understanding of this invention reference should now be had to the preferred embodiments illustrated in greater detail in the accompanying drawings and described below. In the drawings, which are not necessarily to scale.

DESCRIPTION

Figure 1:
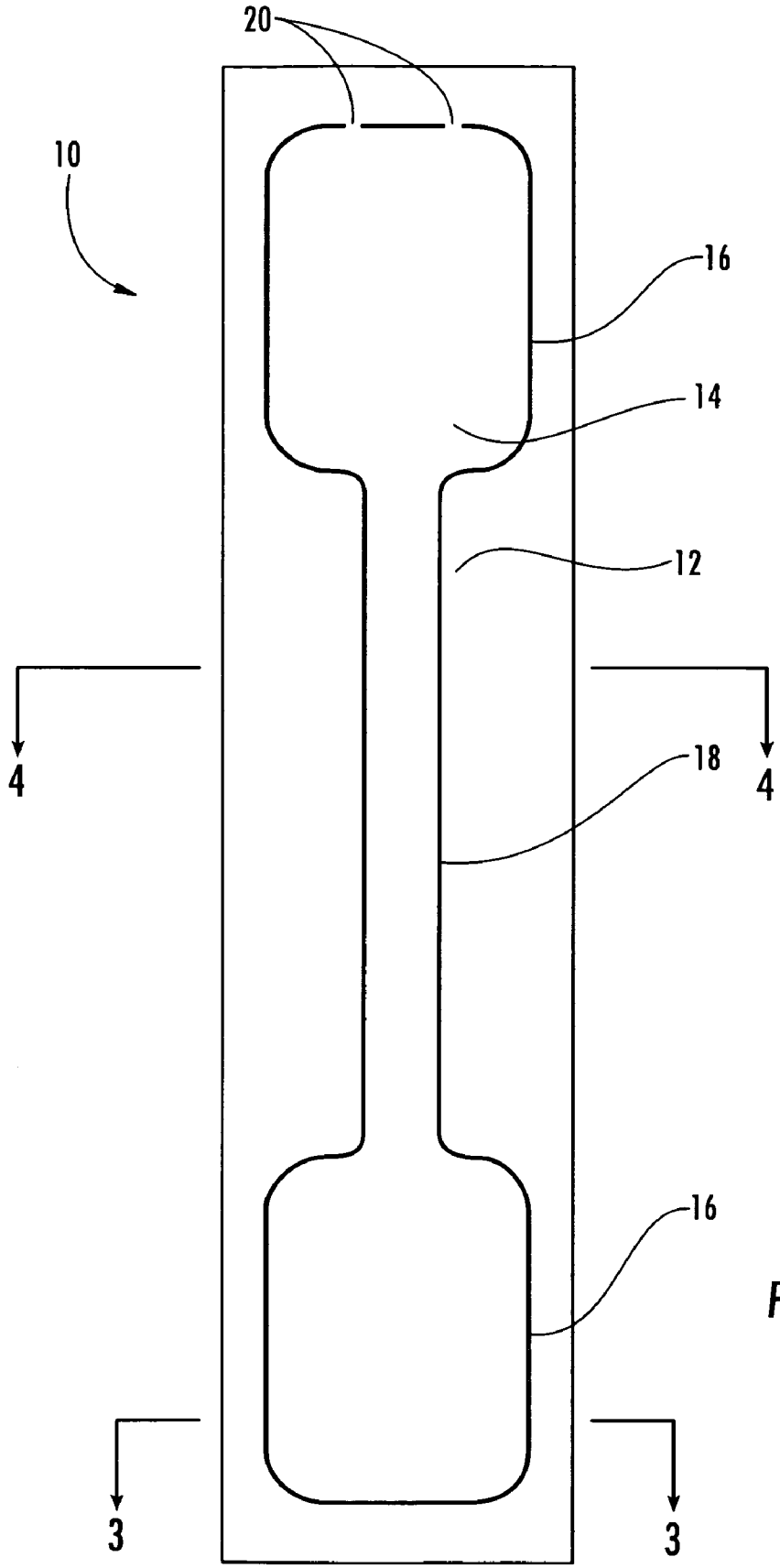
FIG. 1 is a plan view of a laminate structure in accordance with a preferred embodiment of the present invention, wherein the printable side of the printable layer is visible.

The present invention will now be described fully hereinafter with reference to the accompanying drawings, in which preferred embodiments of the invention are shown. This invention may, however, be embodied in many different forms and should not be construed as limited to the preferred embodiments set forth herein. Rather, these preferred embodiments are provided so that this disclosure will be thorough and complete, and will fully convey the scope of the invention to those skilled in the art. It will be understood that all alternatives, modifications, and equivalents are intended to be included within the spirit and scope of the invention as defined by the appended claims.

FIGS. 1-4 illustrate a preferred embodiment of the present invention in which a laminate structure 10 has a printable layer 12, an adhesive layer 40 and a backing layer 44. The printable layer 12 and the backing layer 44 of the laminate structure 10 are substantially coextensive with each other. In a preferred embodiment, the laminate structure is generally rectangular in shape.

The outermost surface of the printable layer 12 of the laminate structure 10—i.e., the surface to which printing is applied—is referred to herein as the "printable side" of the printable layer 12. The other surface of the printable layer 12—i.e., the surface nearest to the backing layer 44—is referred to herein as the "adhesive side" of the printable layer 12. Similarly, when the identification band 30 is removed from the matrix, or remaining part of the laminate structure 10, the identification band 30 also has a printable side to which print is applied and an adhesive side to which adhesive is applied.

With respect to directional references herein, "length" refers to dimensions in the longitudinal direction of the laminate structure; "width" refers to dimensions in the transverse direction of the laminate structure; and "thickness" refers to dimensions in a direction that is normal to the printable surface of the printable layer. The "ends" of the laminate structure are the farthest-most edges of the laminate structure in the longitudinal direction. The "sides" of the laminate structure are the farthest-most edges of the laminate structure in the transverse direction.

Any suitable material may be used as the printable layer 12. Since the printable layer 12 is intended to be removed from the laminate structure 10 and used as an identification band, the material selected for use as the printable layer should have the following characteristics: a printable side suitable for printing upon, preferably using known printers; sufficient pliability to enable the laminate structure to be wrapped without breaking around a patient's wrist or ankle with the ends of the structure adhered together; sufficient material strength to withstand, without significant degradation, rubbing against bedding materials, baths, showers and other activities typically done by or to hospital patients; and hypoallergenic. It has been found that a particularly suitable material for use as the printable layer is a biaxially oriented polypropylene film coated with a thermosensitive coating and a UV topcoat. Advantageously, a printable layer 12 made of such material is compatible with conventional direct thermal printers, has excellent resistance to various oils, plasticizers and alcohol and is not subject to degradation when immersed in cool or moderately warm water (although extremely hot water may cause significant degradation).

The backing layer 44 similarly is composed of a pliable material that allows the printable layer 12 and adhesive layer 40 to be easily detachable therefrom. In a preferred embodiment, the backing layer 44 is a calendared paper with a silicon or other adhesive resistant coating.

The adhesive layer 40 in a preferred embodiment is comprised of a pressure sensitive adhesive suitable for maintaining the printable layer 12 in contact with the backing layer 44 but also allowing the printable layer 12 to be removed from the backing layer 44 without materially damaging either the printable layer 12 or the backing layer 44. It has been found that a hot melt adhesive is suitable for use as the adhesive layer 40. When using such a hot melt adhesive in structures in which a thermosensitive material is used as the printable layer, care must be exercised to ensure that the hot melt adhesive does not activate the thermosensitive printable layer during manufacture of the laminate structure. Preferably, the adhesive used in the adhesive layer 40 is approved by the U.S. Food and Drug Administration for contact with human skin.

Suitable materials for use in the laminate structure 10, including the printable layer 12, the backing layer 44 and the adhesive layer 40, are generally available and may be obtained, for example, from CCL Industries, Inc. in Upland, Calif. 91786-4377.

As will be readily understood by those in the art, various coatings may be applied to the printable layer 12 and the backing layer 44 and the presence of such coatings shall not depart from the scope of the present invention. For example, a UV coating may be applied to the printable layer.

Figure 2:
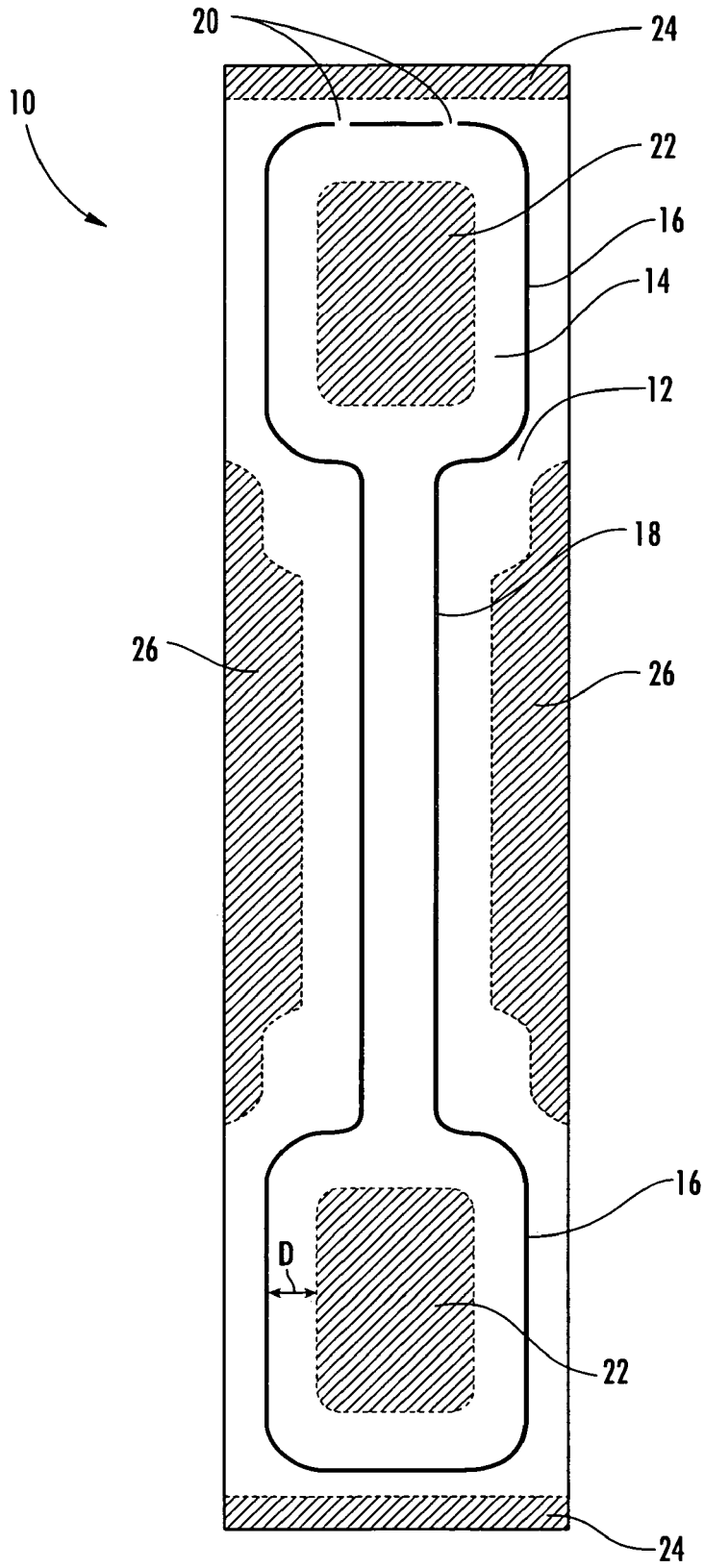
FIG. 2 is a plan view of the adhesive side of the printable layer of the laminate structure of FIG. 1 with adhesive adhered thereto.
Figure 3:
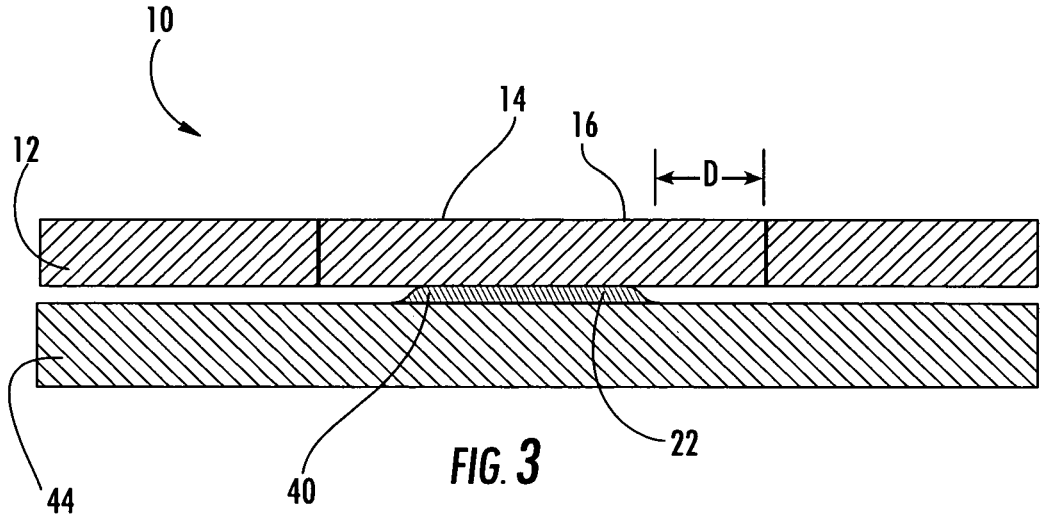
FIG. 3 is a sectional view of the laminate structure of FIG. 1 taken along the line 3-3 thereof.
Figure 4:
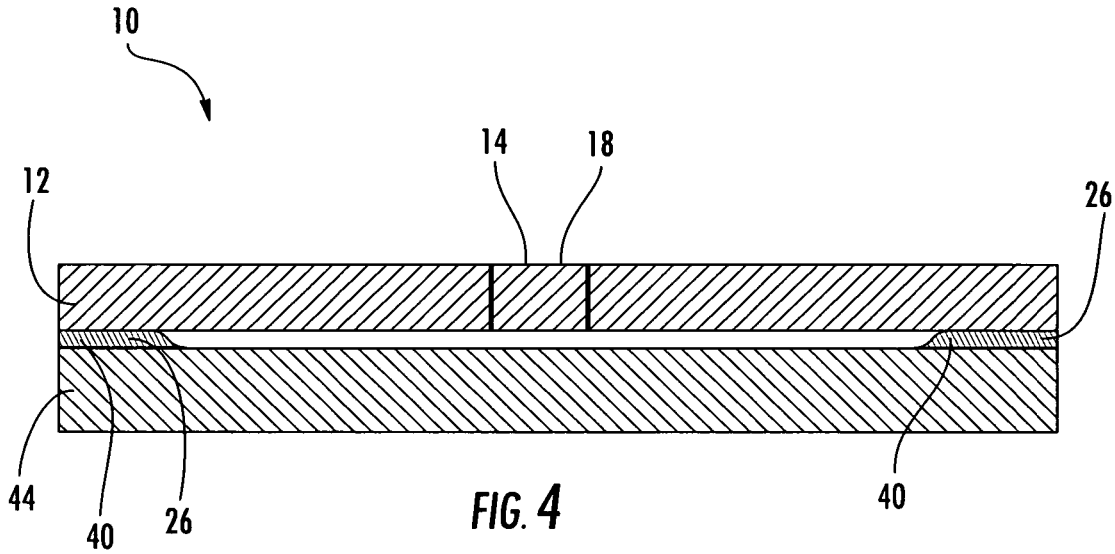
FIG. 4 is a sectional view of the laminate structure of FIG. 1 taken along the line 4-4 thereof.

As shown in FIGS. 2-4, the adhesive layer 40 is not coextensive with the printable layer 12 and the backing layer 44. Rather, the adhesive layer consists of a plurality of adhesive deposits that together maintain adhesion between the printable layer 12 and the backing layer 44 while also allowing for the removal of the identification band 30 from the laminate structure without material degradation of either the identification band 30 or the backing layer 44. In a preferred embodiment, the adhesive layer 40 covers between about fifty percent to about eighty percent of the area of the printable layer 12 and the adhesive layer 40 is relatively permanently attached to the printable layer 12 such that the adhesive layer 40 remains attached to the adhesive side of the printable layer 12 when the printable layer is separated from the backing layer 44.

A particularly advantageous pattern of adhesive deposits useful in rectangular laminate structures according to the present invention is illustrated in FIG. 2. In this pattern, six adhesive deposits are located between the printable layer 12 and the backing layer 44. Two adhesive deposits 24 are spaced from each other in the longitudinal direction and each such deposit is adjacent to one end of the laminate structure. Two adhesive deposits 26 are spaced from each other in the transverse direction and each such deposit is adjacent to one side of the laminate structure. Two adhesive deposits 22, hereinafter referred to as interior adhesive deposits, are spaced from each other in the longitudinal direction and neither of such deposits is adjacent to any side or end of the laminate structure.

Advantageously, the adhesive deposits may be of substantially equal thicknesses and arranged such that the overall thickness of the laminate structure 10 is substantially uniform in order to facilitate travel of the laminate structure 10 through conventional printers and positioning of the printable side of the printable layer relative to the print head within tolerances necessary for accurate printing.

As illustrated in FIGS. 1-2, the printable layer 12 is cut (and may advantageously be die cut) to form an identification band portion 14 having two equal sized patient identification areas 16 joined by a connector band 18 having a width less than the width of the patient identification areas 16. The shape of the identification band portion is commonly referred to within the art as a "dumbbell shape." The identification band portion 14 is cut into the printable lawyer 12 such that one interior adhesive deposit 22 is adjacent each patient identification area 16 and none of the other four adhesive deposits 22, 24 are within the identification band portion 14. In a preferred embodiment, the connector band width does not exceed 7 mm and the connector band length does not exceed 95 mm. In a preferred embodiment, the patient identification area length does not exceed 60 mm and the patient identification area width does not exceed 35 mm. In another preferred embodiment, the connector band length is about 76 mm, the length of each patient identification area is about 38 mm and the width of each patient identification area is about 28 mm.

When cutting the printable layer 12 of the laminate structure 10 the identification band portion 14 may remain attached to the other portion of the printable layer 12 by one of more small uncut portions 20. Positioning one or more uncut portions 20 between each patient identification area 16 and the respective end of the laminate structure 10 may advantageously be used to help prevent the identification band portion 14 from detaching from the laminate structure as the structure travels through a printer. When present, the one or more small uncut portions 20 should be of a size that does not interfere with removal of the identification band portion 14 from the laminate structure 10 or cause material degradation to the identification band portion 14, or to the printable layer of the identification band portion, as it is removed.

With reference to FIG. 2, in a preferred embodiment of the present invention the periphery of each interior adhesive deposit 22 does not abut the periphery of the adjacent patient identification area 16. Advantageously, a distance D between the periphery of each interior adhesive deposit 22 and the periphery of the adjacent patient identification area 16 is about 2 mm to about 4 mm.

Figure 12:
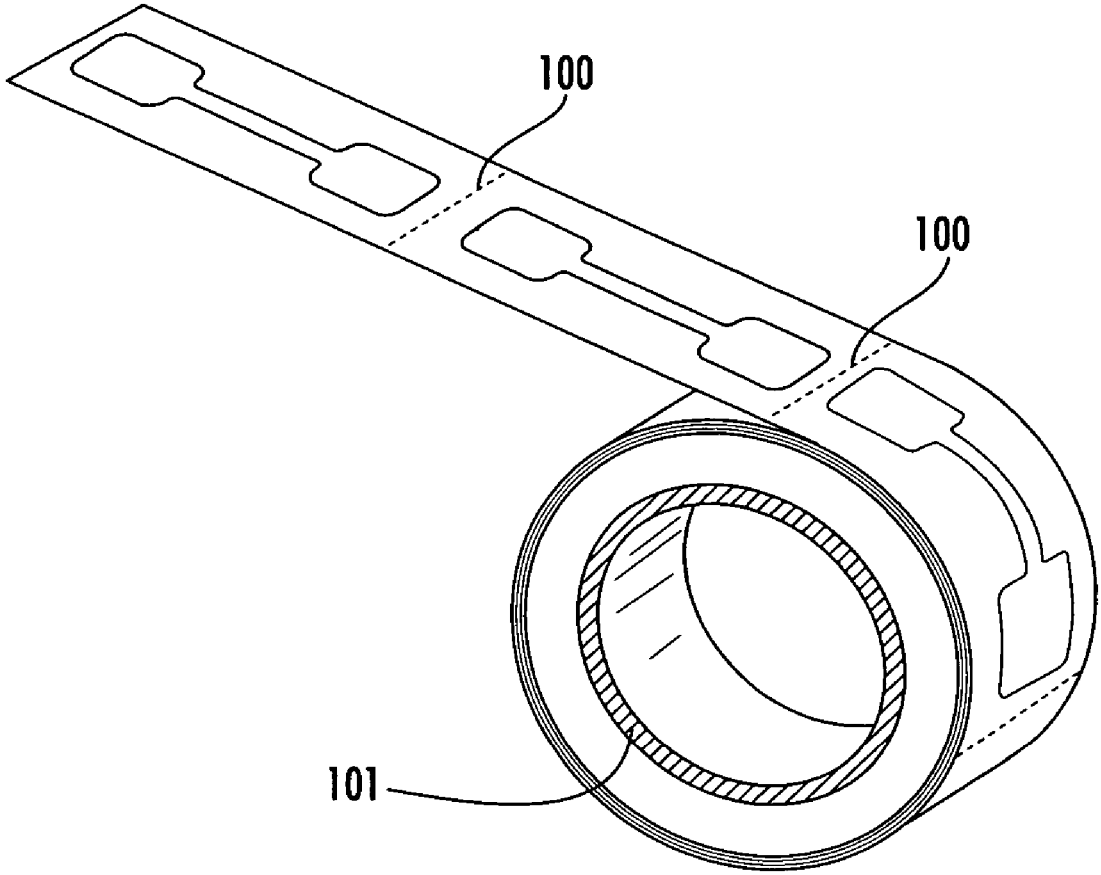
FIG. 12 is a perspective view of a roll of laminate structures.

As illustrated in FIG. 12, the laminate structure 10 described above may be manufactured in series such that a plurality of laminate structures attached together in end-to-end relationship are wound in a roll around a tube 101 of cardboard or other suitable material. Individual laminate structures within the roll may be separated by transverse perforations 100 such that an individual laminate structure is separable from the roll by tearing along the perforation. As will be appreciated by those in the art, a transverse dark marker line may be printed on the outside of the backing layer to facilitate use of the laminate structure with conventional machines such as printers, which often detect the presence of such a line to correctly position the laminate structure within the machine.

Figure 5:
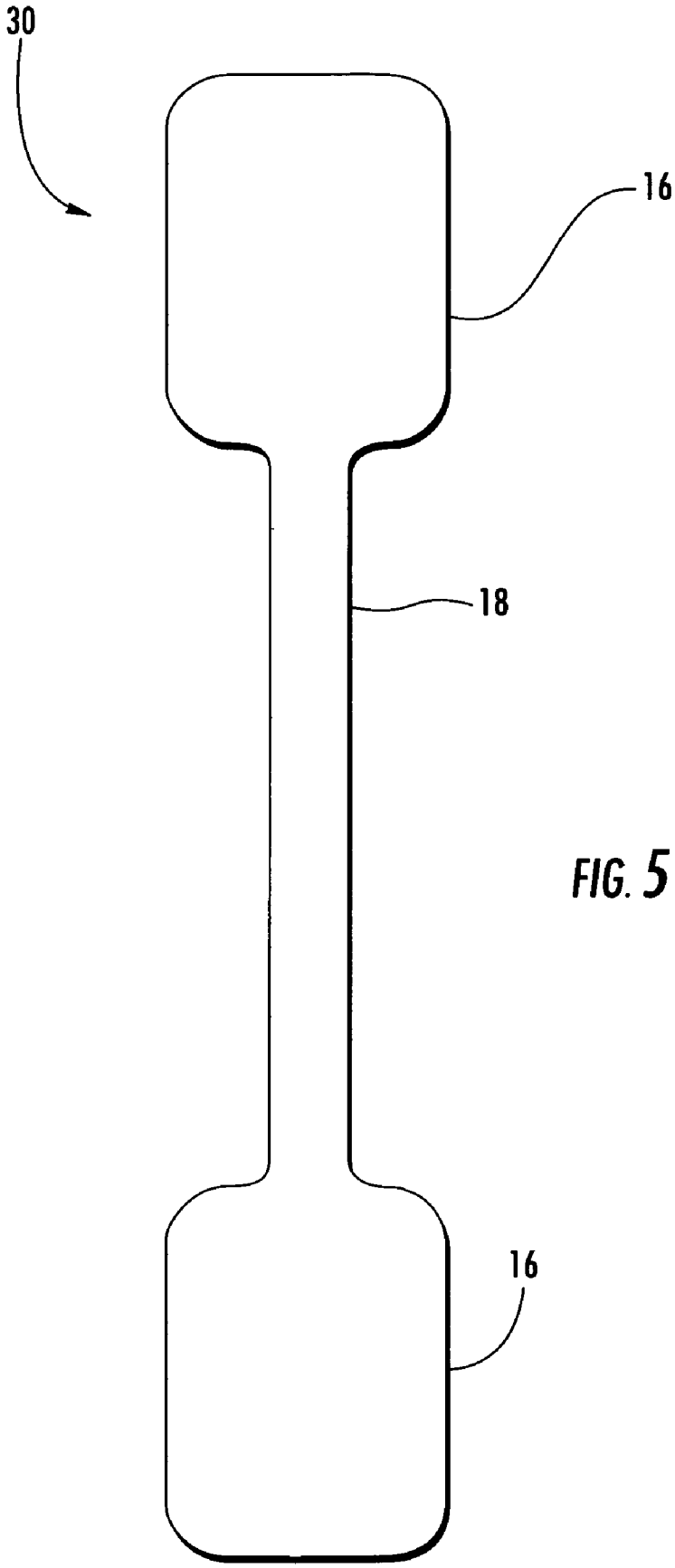
FIG. 5 is a plan view of the printable side of the identification band detached from the laminate structure of FIG. 1.
Figure 6:
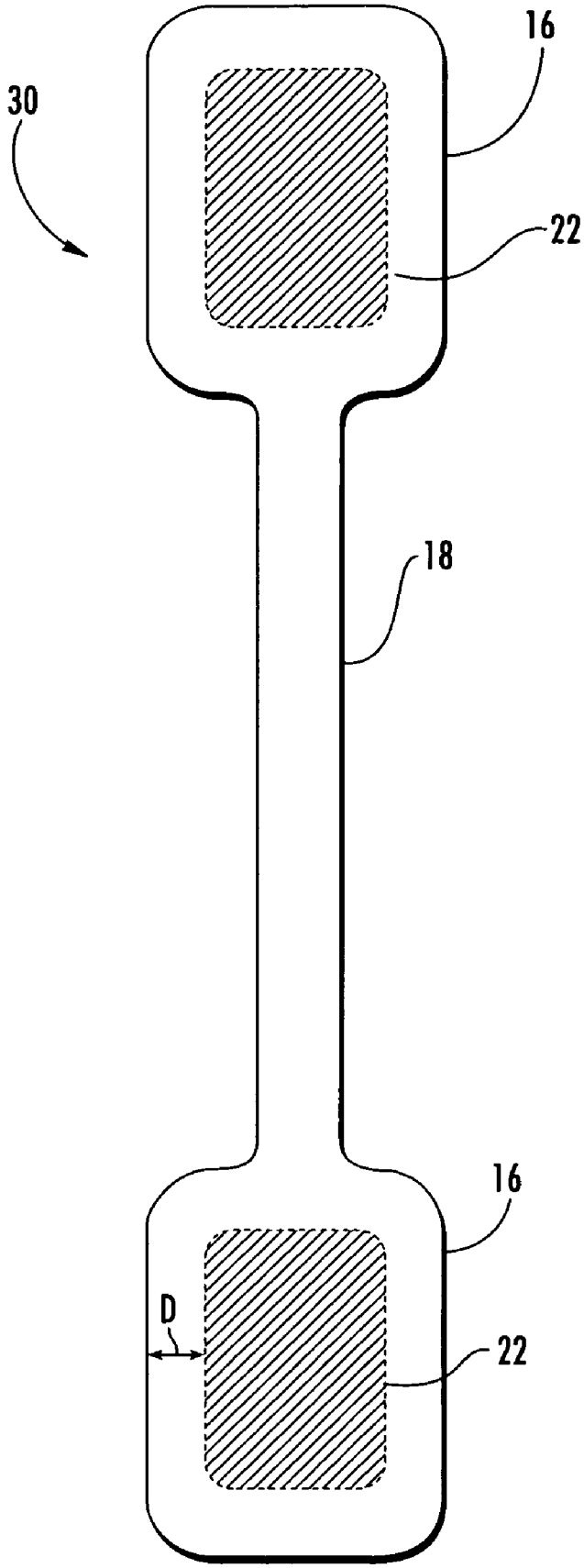
FIG. 6 is a plan view of the adhesive side of the identification band of FIG. 5 with adhesive adhered thereto.

With reference to FIGS. 5-6, the identification band portion 14 cut in the printable layer 12 is detachable from the laminate structure 10 so as to form an identification band depicted generally at 30. As shown in FIG. 6, when the identification band portion 14 is detached from the laminate structure 10 to form the identification band 30, each of the two interior adhesive deposits 22 remains adhered to the adjacent patient identification area 16.

Patient identifying indicia 34 such as text, pictures, barcode data, or a combination thereof, may be printed on the printable side of one or both of the patient identification areas 16 of the laminate structure 10 using a conventional printer. After the desired patient identifying indicia 34 is printed on the laminate structure, the identification band portion 14 is removed from the laminate structure for use as an identification band 30.

Figure 7:
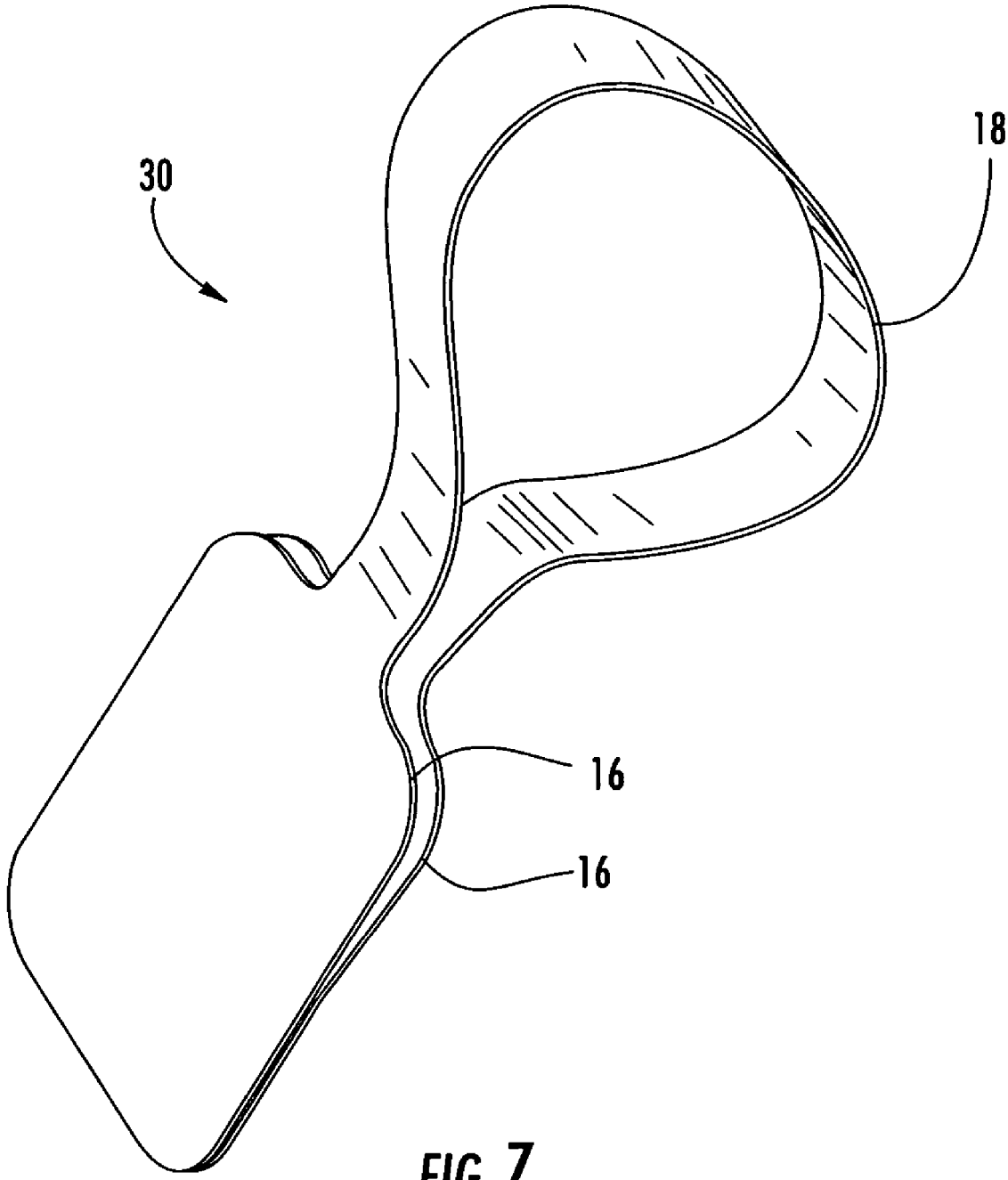
FIG. 7 is a perspective view of the identification band of FIG. 5 with the ends thereof adhesively joined together.
Figure 8:
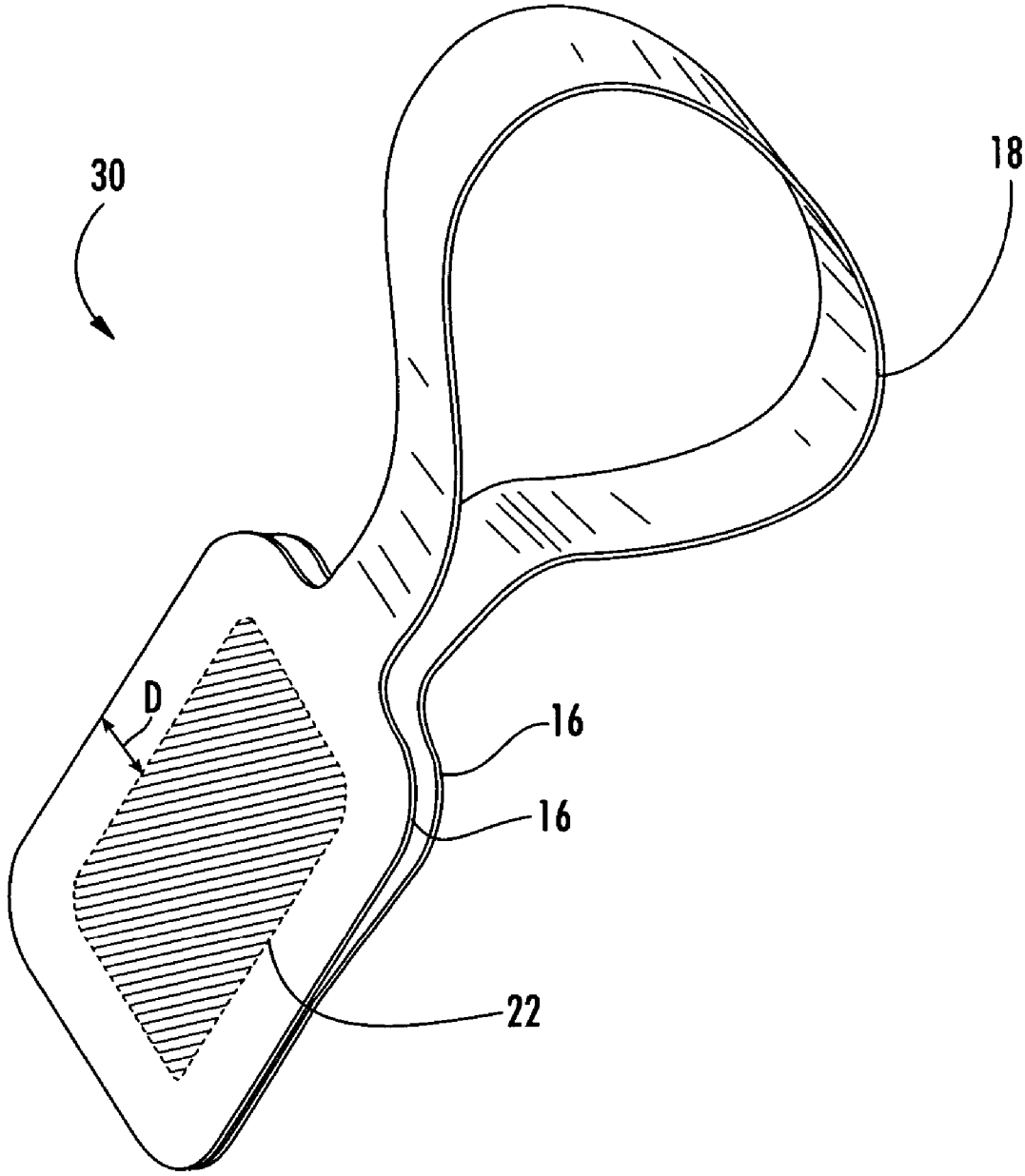
FIG. 8 is a perspective view of the identification band of FIG. 7 showing the adhesive deposits between the printable layer and the backing layer in phantom lines.
Figure 9:
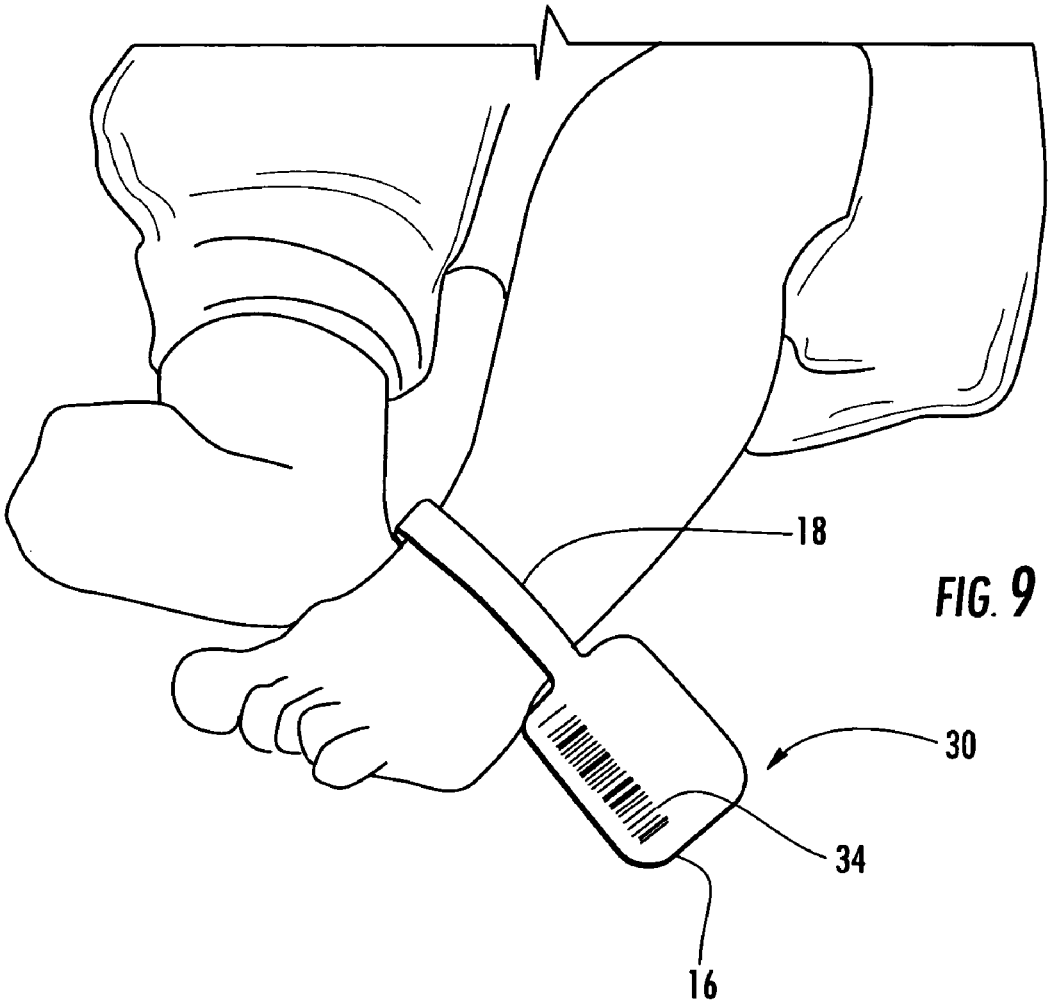
FIG. 9 is a perspective view of the identification band of FIG. 7 secured around the ankle of an infant or neonate.

With respect to FIGS. 7-9, the identification band 30 is formed into a closed loop around an infant's or neonate's wrist or ankle by wrapping the connector band 18 around the wrist or ankle, aligning each of the patient identification areas 16 together in face-to-face alignment such that the interior adhesive deposits 22 on the adhesive side of each patient identification area 16 are facing each other, and then pressing the patient identification areas 16 (and hence the two interior adhesive deposits 22) together against each other. Advantageously, when the identification band 30 is assembled into the closed loop around the wrist or ankle of a neonate, the periphery of each interior adhesive deposit 22 is spaced from the periphery of the patient identification areas 16 by a distance D. As a result, no adhesive contacts the skin of the infant or neonate.

While the identification band 30 may be particularly suited to use by infants and neonates, use of the identification band 30 with other patients does not depart from the scope of the invention.

Figure 10:
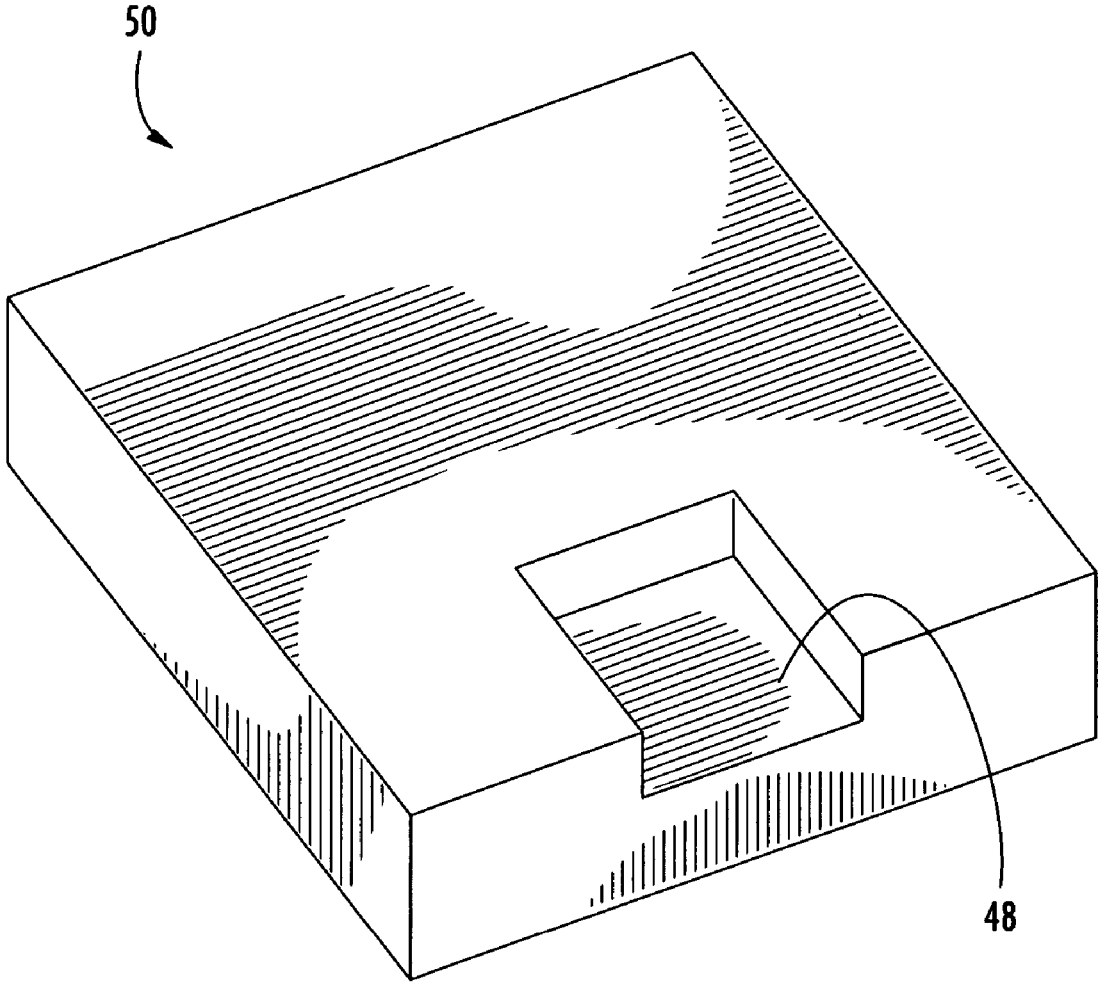
FIGS. 10 and 11 are perspective views of an assembly jig for use in securing the identification band around the wrist or ankle of an infant or neonate.
Figure 11:
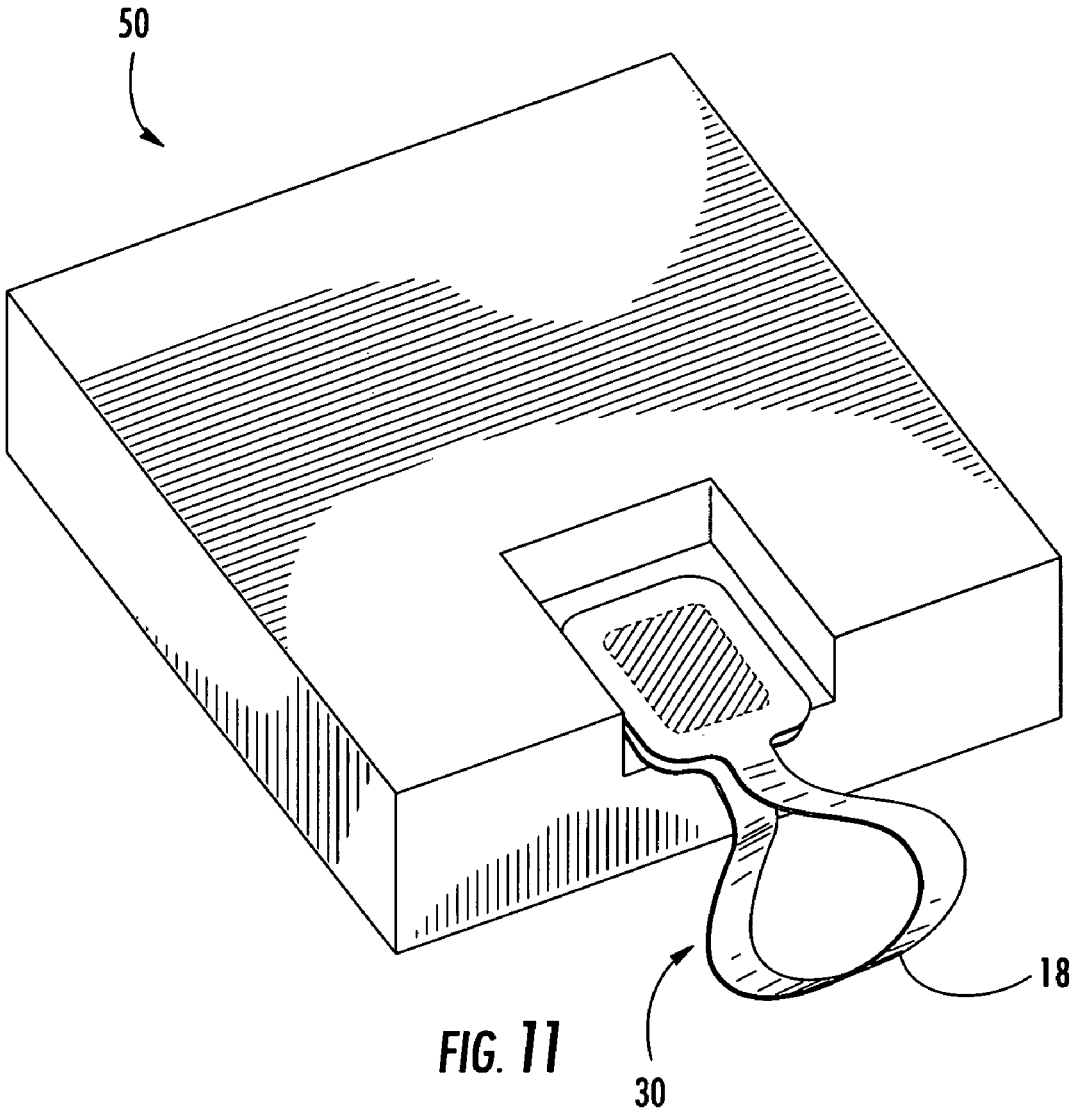

With respect to FIG. 10, an assembly jig 50 having an indentation zone 48 with a length and width generally corresponding to the identification areas 16 of the identification band 30 may be used to help ensure face-to-face alignment of the patient identification areas while assembling the identification band. When the identification band 30 is formed around the wrist or ankle of a neonate, the patient identification areas thereof may be positioned together in the indentation zone 48 of the assembly jig 50 to ensure proper alignment of the interior adhesive deposits 22. As such, the assembly jig 50 assists in ensuring that the adhesive holding the ends of the indentation bracelet 30 together remains interiorly isolated and does not come into contact with the skin of the neonate. The assembly jig 50 may be manufactured of any durable material, such as various cardboards, plastics or metals.

The laminate structure 10 and the identification band 30 are each highly flexible and durable. The identification band 30 may have rounded corners to minimize abrasion to the infant's or neonate's skin. The dimensions of the laminate structure 10 and the identification band 30 are selected such that the identification band fits comfortably around the wrist or ankle of an infant or neonate, but is not so loose as to slip off of the neonate's or infant's wrist or ankle. The patient identification areas 16 of the identification band 30 are sized to be large enough to print the desired patient identifying indicia 34 thereon, but not so large as to unduly interfere with the infant or neonate. In a preferred embodiment, the connection band 18 of the identification band 30 has a length between about 7 cm and about 8 cm and a width between about 0.5 cm to about 1 cm, and the patient information areas 16 have a length between about 3 cm to about 4 cm and a width between about 2 cm and about 3 cm. Other possible dimensions for the identification band 30 are within the scope of the invention, provided that the identification band is long enough to wrap around the wrist or ankle of a neonate.

The laminate structure 10 preferably has a generally rectangular shape, although other shapes may be used without departing from the scope of the invention. A laminate structure 10 having a generally rectangular shape is easily fed into a conventional printer for printing identification indicia 34 thereon. A particularly advantageous laminate structure 10 has a length between about 16 cm and about 18 cm and a width between about 3 cm and about 5 cm.

As shown above, the laminate structure and identification band of the present invention solve the existing problems in the art by providing a laminate structure 10 capable of use with conventional printers and an identification band particularly suited for use with infants and neonates that not only minimizes the possibility of skin contact with adhesive, but also provides patient identification areas that are easily viewable while the infant or neonate sleeps because the patient identifying indicia is printed on flat portions of the band that extend from the neonate when the band is secured around a wrist or ankle and not printed circumferentially around an identification bracelet.

It will be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiments, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. An pliable laminate structure comprising:

a backing layer;

a printable layer substantially coextensive with said backing layer having a printable side suitable for printing thereon and an adhesive side, said printable layer being cut therethrough to define a removable portion having a shape comprising two equal-sized patient identification areas joined by a connector band having a width less than the width of each of the equal-sized patient identification areas; and an adhesive layer between said printable layer and said backing layer removably adhering said printable layer to said backing layer such that when the removable portion of said printable layer is removed from said backing layer, adhesive remains adhered to the adhesive side of at least one of the equal-sized patient identification areas and no adhesive remains adhered to the connector band of the removable portion, whereby patient information when printed on the printable side of one or both of the equal-sized patient identification areas is readable when the removable portion of the printable layer is removed from the backing layer and secured around the wrist or ankle of an infant or neonate by wrapping the connector band around such wrist or ankle and pressing together the adhesive sides of the equal-sized patient identification areas thereby causing the adhesive adhered on the adhesive side of at least one of the equal-sized patient identification areas to adhere the two equal-sized patient identification areas together.

2. A pliable laminate structure as defined in claim 1 wherein said adhesive layer comprises a plurality of discrete adhesive deposits.

3. A pliable laminate structure as defined in claim 2 wherein an adhesive deposit in the plurality of adhesive deposits is adhered to the adhesive side of at least one of the equal-sized patient identification areas.

4. A pliable laminate structure as defined in claim 3 wherein the adhesive deposit adhered to the adhesive side of at least one of the equal-sized patient identification areas is not coextensive with such equal-sized patient identification area and does not abut the periphery of such equal-sized patient identification area.

5. A pliable laminate structure as defined in claim 4 wherein the distance between the periphery of an equal-sized patient identification area and the periphery of an adhesive deposit adhered thereto is between about 2 mm to about 4 mm.

6. A pliable laminate structure as defined in claim 2 wherein said adhesive layer comprises six discrete adhesive deposits positioned such that one adhesive deposit is adhered to the adhesive side of each equal-sized patient identification area, one adhesive deposit abuts each side of the laminate structure, and one adhesive deposit abuts each end of the laminate structure.

7. A pliable laminate structure as defined in claim 2 wherein the printable layer comprises a biaxially oriented polypropylene film coated with a thermosensitive coating and a UV topcoat and is suitable for direct thermal printing thereon.

8. A pliable laminate structure as defined in claim 1 wherein the laminate structure has a length within the range of about 16 cm to about 18 cm and a width within the range of about 3 cm to about 5 cm.

9. A pliable laminate structure as defined in claim 1 further comprising at least one uncut portion connecting the removable portion of said printable layer to a portion of said printable layer that is not the removable portion.

10. A pliable laminate structure as defined in claim 1 wherein the length of the connector band of the removable portion of said printable layer is within the range of about 7 cm to about 8 cm.

11. A pliable laminate structure as defined in claim 1 wherein the width of the connector band of the removable portion of said printable layer is within the range of about 0.5 cm to about 1 cm.

12. A pliable laminate structure as defined in claim 1 wherein the width of each of the equal-sized patient identification areas of the removable portion of said printable layer is within the range of about 2 cm to about 3 cm.

13. A pliable laminate structure as defined in claim 1 wherein said adhesive layer comprises a pressure sensitive adhesive approved for human skin contact by the United States Food and Drug Administration.

14. A pliable laminate structure as defined in claim 13 wherein the pressure sensitive adhesive is a hot melt pressure sensitive adhesive.

15. A pliable laminate structure as defined in claim 1 wherein the area of said adhesive layer is at least fifty percent of the area of the adhesive side of said printable layer.

16. A pliable laminate structure as defined in claim 15 wherein the area of said adhesive layer is less than eighty-one fifty percent of the area of the adhesive side of said printable layer.

17. A pliable laminate structure as defined in claim 1 further comprising printing on the printable side of at least one of the equal-sized patient identification areas of the removable portion of said printable layer.

18. An identification band for attachment around an infant or neonate wrist or ankle of predetermined diameter comprising:

a pliable band having a printable side suitable for printing thereon and an adhesive side, said pliable band having a shape comprising two equal-sized patient identification portions joined by a connector band portion having a width less than the width of each of the equal-sized patient identification portions and a length greater than the predetermined diameter; and adhesive adhered to the adhesive side of at least one of the two equal-sized patient identification portions but not adhered to the connector band portion, said adhesive being adhered to the adhesive side of at least one of the two equal-sized patient identification portions such that the adhesive does not abut the periphery of such at least one equal-sized patient identification portion to which such adhesive is adhered, whereby patient information when printed on the printable side of one or both of the equal-sized patient identification portions is readable when the identification band is attached around an infant or neonate wrist or ankle of predetermined diameter by wrapping the connector band portion around such wrist or ankle and pressing together the adhesive sides of the equal-sized patient identification portions thereby causing the adhesive adhered on the adhesive side of at least one of the equal-sized patient identification portions to adhere the two equal-sized patient identification portions together.

19. An identification band for attachment around an infant or neonate wrist or ankle of predetermined diameter as defined in claim 18 wherein said a pliable band comprises a biaxially oriented polypropylene film coated with a thermosensitive coating and a UV topcoat and is suitable for direct thermal printing thereon.

20. An identification band for attachment around an infant or neonate wrist or ankle of predetermined diameter as defined in claim 19 wherein the distance between the periphery of an equal-sized patient identification portion and the periphery of an adhesive deposit adhered thereto is between about 2 mm to about 4 mm.

21. An identification band for attachment around an infant or neonate wrist or ankle of predetermined diameter as defined in claim 19 wherein the pliable band comprises material suitable for direct thermal printing thereon.

22. An identification band for attachment around an infant or neonate wrist or ankle of predetermined diameter as defined in claim 19 wherein the length of the connector band portion is within the range of about 7 cm to about 8 cm.

23. An identification band for attachment around an infant or neonate wrist or ankle of predetermined diameter as defined in claim 22 wherein the pliable band has a length within the range of about 16 cm to about 18 cm.

24. An identification band for attachment around an infant or neonate wrist or ankle of predetermined diameter as defined in claim 23 wherein the width of the connector band portion is within the range of about 0.5 cm to about 1 cm.

25. An identification band for attachment around an infant or neonate wrist or ankle of predetermined diameter as defined in claim 22 wherein the width of each of the equal-sized patient identification portions is within the range of about 2 cm to about 3 cm.

26. An identification band for attachment around an infant or neonate wrist or ankle of predetermined diameter as defined in claim 19 wherein the adhesive comprises a pressure sensitive adhesive approved for human skin contact by the United States Food and Drug Administration.

27. An identification band for attachment around an infant or neonate wrist or ankle of predetermined diameter as defined in claim 26 wherein the pressure sensitive adhesive is a hot melt pressure sensitive adhesive.

28. An identification band for attachment around an infant or neonate wrist or ankle of predetermined diameter as defined in claim 19 further comprising patient identification information printed on at least one of the equal-sized patient identification portions of the pliable band.

29. A method of identifying an infant or neonate patient comprising:

printing patient identification information corresponding to the infant or neonate patient on at least one patient identification area of a pliable laminate structure comprising a backing layer;

a printable layer substantially coextensive with said backing layer having a printable side suitable for printing thereon and an adhesive side, said printable layer being cut therethrough to define a removable portion having a shape comprising two equal-sized patient identification areas joined by a connector band having a width less than the width of each of the equal-sized patient identification areas; and an adhesive layer between said printable layer and said backing layer removably adhering said printable layer to said backing layer such that when the removable portion of said printable layer is removed from said backing layer, adhesive remains adhered to the adhesive side of at least one of the equal-sized patient identification areas and no adhesive remains adhered to the connector band of the removable portion;

removing the removable portion of the printable layer of the pliable laminate structure from the backing layer of the pliable laminate structure; and securing the removable portion of the printable layer of the pliable laminate structure around the wrist or ankle of the infant or neonate patient by wrapping the connector band around such wrist or ankle and pressing together the adhesive sides of the equal-sized patient identification areas, thereby causing the adhesive adhered on the adhesive side of at least one of the equal-sized patient identification areas to adhere the two equal-sized patient identification areas together, whereby the patient identification information printed on at least one patient identification area is readable.

30. An article of manufacture comprising:

a plurality of pliable laminate structures in an end-to-end relationship formed into a roll around a tube, each such pliable laminate structure separable from each adjoining pliable laminate structure by transverse perforations, and each such pliable laminate structure comprising a backing layer;

a printable layer substantially coextensive with the backing layer having a printable side suitable for printing thereon and an adhesive side, the printable layer being cut therethrough to define a removable portion having a shape comprising two equal-sized patient identification areas joined by a connector band having a width less than the width of each of the equal-sized patient identification areas; and an adhesive layer between the printable layer and the backing layer removably adhering the printable layer to the backing layer such that when the removable portion of the printable layer is removed from the backing layer, adhesive remains adhered to the adhesive side of at least one of the equal-sized patient identification areas and no adhesive remains adhered to the connector band of the removable portion and information when printed on the printable side of one or both of the equal-sized patient identification areas is readable when the adhesive adhered on the adhesive side of at least one of the equal-sized patient identification areas is applied to adhere the two equal-sized patient identification areas together.

31. An article of manufacture as defined in claim 30 wherein the printable layer of each pliable laminate structure in the plurality of pliable laminate structures comprises a biaxially oriented polypropylene film coated with a thermosensitive coating and a UV topcoat and is suitable for direct thermal printing thereon.

* * * * *